US005132710A

United States Patent [19]

Ejiri et al.

[11] Patent Number: 5,132,710

[45] Date of Patent: Jul. 21, 1992

[54] IMAGE COMMUNICATING APPARATUS HAVING INK JET PRINTER WITH DISCHARGE RECOVERY TIMING DETERMINED BY DATA RECEPTION RATE

[75] Inventors: Seishi Ejiri, Kawasaki; Yasuyuki Shinada, Yokohama, both of Japan

[73] Assignee: Canon Kabushiki Kaisha, Tokyo, Japan

[21] Appl. No.: 658,236

[22] Filed: Feb. 20, 1991

[30] Foreign Application Priority Data

Feb. 23, 1990 [JP] Japan ..... 2-41054

[51] Int. Cl.[5] ..... B41J 2/05

[52] U.S. Cl. ..... 346/140 R; 346/75; 358/296

[58] Field of Search ..... 346/140 R, 75; 358/296

[56] References Cited

U.S. PATENT DOCUMENTS

| | | | |
|---|---|---|---|
| 3,925,789 | 12/1975 | Kashio | 346/75 |
| 4,313,124 | 1/1982 | Hara | 346/140 R |
| 4,333,088 | 6/1982 | Diggins | 346/140 R |
| 4,345,262 | 8/1982 | Shirato et al. | 346/140 R |
| 4,376,283 | 3/1983 | Bower | 346/140 R |
| 4,459,600 | 7/1984 | Sato et al. | 346/140 R |
| 4,463,359 | 7/1984 | Ayata et al. | 346/1.1 |
| 4,489,335 | 12/1984 | Watanabe et al. | 346/140 R |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,835,717 | 8/1989 | Harmon et al. | 346/140 R |
| 4,967,204 | 10/1990 | Terasawa et al. | 346/1.1 |
| 4,977,459 | 12/1990 | Ebinuma et al. | 358/296 |
| 4,999,643 | 3/1991 | Terasawa | 346/1.1 |

FOREIGN PATENT DOCUMENTS

| | | |
|---|---|---|
| 0348234 | 12/1989 | European Pat. Off. . |
| 3234107 | 3/1983 | Fed. Rep. of Germany . |
| 3633239 | 4/1987 | Fed. Rep. of Germany . |
| 59-123670 | 7/1984 | Japan . |
| 59-138461 | 8/1984 | Japan . |

*Primary Examiner*—Benjamin R. Fuller
*Assistant Examiner*—Victor DeVito
*Attorney, Agent, or Firm*—Fitzpatrick, Cella, Harper & Scinto

[57] ABSTRACT

A facsimile apparatus employs an ink jet printer in which the ink discharge recovery operation by idle ink discharge from all the discharge openings of the recording head is conducted at a suitable timing instructed by a central processing unit. The timing of the idle ink discharge is determined not by a timer interruption procedure, which imposes an additional burden on the processing capacity of the central processing unit, but from the image data receiving rate and the amount of actually received data. In this manner the central processing unit can provide increased processing capacity, and the control program can be simplified and made less expensive.

9 Claims, 7 Drawing Sheets

IMAGE COMMUNICATING APPARATUS HAVING INK JET PRINTER WITH DISCHARGE RECOVERY TIMING DETERMINED BY DATA RECEPTION RATE

BACKGROUND OF THE INVENTION

1. Field of the Invention

The present invention relates to an image communicating apparatus such as a facsimile apparatus, and more particularly to an image communicating apparatus equipped with an ink jet printer provided with plural ink discharge openings (orifices).

2. Related Background Art

There has recently been developed an ink jet printer for recording characters or an image by discharging ink from discharge openings to a recording material, utilizing bubbles generated by thermal energy. Because the heat generating member (heater) provided in each discharge opening is significantly smaller than the piezoelectric element employed in the conventional ink jet printers, this ink jet printer enables a high-density arrangement of multiple discharge openings, thereby providing a recorded image of high quality. In addition it has other advantages such as high speed and low noise.

On the other hand, a facsimile apparatus is required not only to transmit an image at a high speed, but also to receive the image with a high image quality and a high speed. In consideration of the above-mentioned features, the ink jet printer of the method discharging the ink toward the recording material utilizing the bubbles generated by thermal energy is considered as one of the printers capable of meeting such requirements, but there has not been provided a facsimile apparatus equipped with such an ink jet printer.

In such an ink jet printer, the ink discharge openings of the recording head may be clogged by the ink which is viscosified by a pause in the use of the recording head, or in a low humidity situation or by a difference in the frequency of use, or by the deposition of dust. For this reason there has been employed a discharge recovery mechanism for removing such viscosified ink by pressurizing the discharge openings from the interior of the recording head, or by sucking said ink from a protective cap for covering the discharge openings of the recording head. Also during a recording operation, the frequency of ink discharge is not uniform among the discharge openings, so that some openings may never be used and those used infrequently may cause clogging. Since such clogging deteriorates the image quality, the discharge recovery process is generally conducted at a regular interval, and for this purpose there is provided an interruption timer for interruption process.

However, in realizing a facsimile apparatus equipped with such an ink jet printer, if such discharge recovery process is conducted by a particular timer interruption as explained above, such interruption process increases the burden on the central processing unit and complicates the control program, and such complication is undesirable for a facsimile apparatus which must to achieve multiple functions with a simple and inexpensive structure.

SUMMARY OF THE INVENTION

In consideration of the foregoing, an object of the present invention is to provide an improved image communicating apparatus.

Another object of the present invention is to provide an image communicating apparatus capable of constantly stable recording.

Still another object of the present invention is to provide an image communicating apparatus capable of conducting the ink discharge recovery process at secure timings for idle discharge, without particular timer interruption process.

Still another object of the present invention is to provide an image communicating apparatus utilizing a fact that the number of received data per unit time is determined by the data receiving rate of the image signal without any practical fluctuation.

Still another object of the present invention is to provide an image communicating apparatus capable of obtaining secure timings of idle discharge by defining said timing from the data receiving rate and the number of actually received data, without requiring a particular timer interruption process.

Still another object of the present invention is to provide an image communicating apparatus not requiring an interruption process for the idle ink discharge, thereby improving the performance with reduced burden on the central processing unit and with simplified control program.

Still another object of the present invention is to provide an image communicating apparatus in which the timing of idle discharge is instructed according to the data receiving rate of image and the number of actually received data, and at least an ink discharge not intended for image recording is conducted in all the ink discharge openings at thus instructed timing of idle discharge.

The foregoing and still other objects of the present invention will become fully apparent from the following description to be taken in conjunction with the attached drawings.

DETAILED DESCRIPTION OF THE PREFERRED EMBODIMENTS

Now the present invention will be clarified in detail by embodiments thereof shown in the attached drawings.

Basic structure

Figure 1:
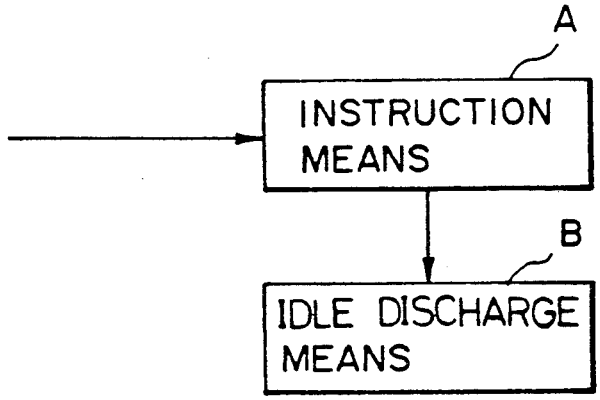
FIG. 1 is a block diagram of the basic structure of an embodiment of the present invention.

FIG. 1 shows the basic structure of an embodiment of the present invention, wherein provided instruction means A for instructing the timing of idle ink discharge based on the data receiving rate of image and the number of actually received data; and idle discharge means B for effecting at least an idle ink discharge, not intended for image recording, from all the discharge openings of the recording head at the timing instructed by said instruction means A.

Structure of recording system (printer)

Figure 2:
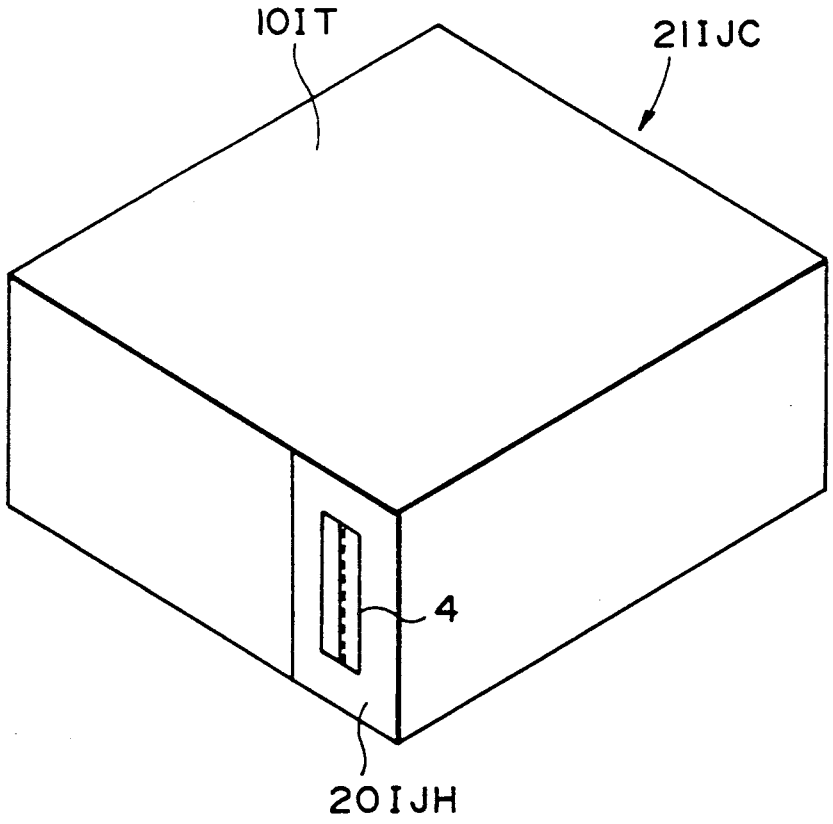
FIG. 2 is a perspective view of an example of the ink cartridge in which the present invention is applicable.
Figure 3:
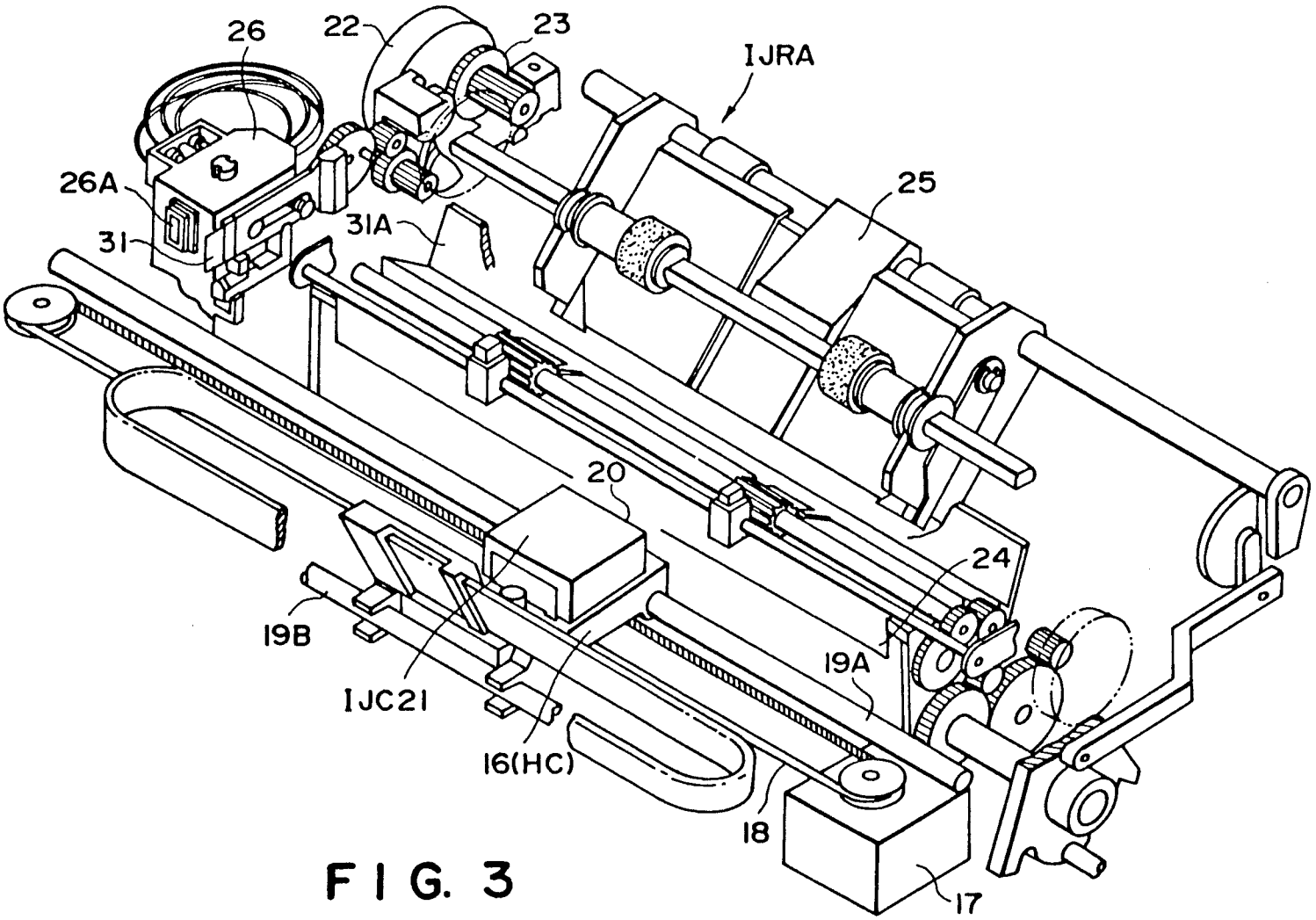
FIG. 3 is a perspective view of an example of the recording system of a facsimile apparatus employing the ink jet cartridge shown in FIG. 2 and capable of embodying the present invention.

FIGS. 2 and 3 illustrate an example of ink jet printer adapted for use as the recording system in a facsimile apparatus embodying the present invention. There are shown an ink jet head (recording head) IJH (20) of a system for discharging ink utilizing thermal energy; a detachable ink jet cartridge IJC (21) equipped with an ink tank IT (10) integral with the ink jet head IJH and adapted to supply ink thereto; and the main body of the ink jet recording apparatus IJRA.

In the ink jet cartridge IJC of the present embodiment, as will be apparent from a perspective view in FIG. 2, the ink jet head IJH slightly protrudes from the front face of the ink tank IT. Said ink jet cartridge IJC is of disposable type, detachably mounted on a carriage of the ink jet recording apparatus IJRA as will be explained later.

A first ink tank IT, containing ink for supply to the ink jet head IJH, is composed of an ink absorbent member, a container therefor and a cover member for closing said container (these members not shown). Said ink tank IT (10) is filled with ink and supplies said ink to the ink jet head according to ink discharge therefrom.

In the present embodiment, a front plate 4 is composed of a resinous material with high ink resistance, such as polysulfone, polyethersulfone, polyphenylene oxide or polypropylene.

The ink jet cartridge IJC of the above-explained structure is detachably mounted on the carriage HC of the ink jet recording apparatus IJRA explained in the following, and effects formation of a recorded image by relative movement of the carriage HC and a recording material, in response to the entry of a recording signal.

FIG. 3 is a perspective view of an example of the ink jet recording apparatus IJRA equipped with mechanisms for the above-mentioned operations.

Referring to FIG. 3, the ink jet head (recording head) 20 of the ink jet cartridge IJC is provided with nozzles for discharging ink toward a recording surface of a recording sheet supplied from a sheet feeding unit 25 onto a platen 24. A carriage (HC) 16, for supporting said recording head 20, is linked with a part of a driving belt 18 for transmitting the driving power of a driving motor 17, and is capable of reciprocating over the entire width of the recording sheet by sliding along two mutually parallel guide shafts 19A, 19B.

A head recovery unit 26, positioned at an end of the moving path of the recording head 20, for example at a position corresponding to the home position of the recording head 20, effects capping therefor when activated by a motor 22 through a transmission mechanism 23. In combination with the capping operation by a cap 26A, there is conducted a discharge recovery operation by ink suction (suction recovery) by suitable suction means (for example a suction pump) provided in the recovery unit 26 or by forced discharge of viscosified ink from the discharge openings by pressurizing ink with suitable pressurizing means provided in an ink supply path to the recording head 20 (pressurized recovery). Also the recording head is protected by said capping for example after the recording operation. Such discharge recovery operation is conducted at the start of power supply, at the replacement of the recording head, or at a pause in the recording operation exceeding a predetermined time.

A wiping blade or wiper 31, positioned at a side of the head recovery unit 26 and made of silicone rubber, is supported in a cantilever mechanism by a blade support member 31A and is activated also by the motor 22 and the transmission mechanism 23 for engagement with the ink discharge surface of the recording head 20. Thus the blade 31 is made to protrude into the moving path of the recording head 20 at a suitable timing in the course of recording operation thereof or after the discharge recovery operation therefor by the recovery unit 26, thereby wiping the dew, liquid or dust off said ink discharging surface of the recording head 20 by the movement thereof.

Structure of Control System

Figure 4:
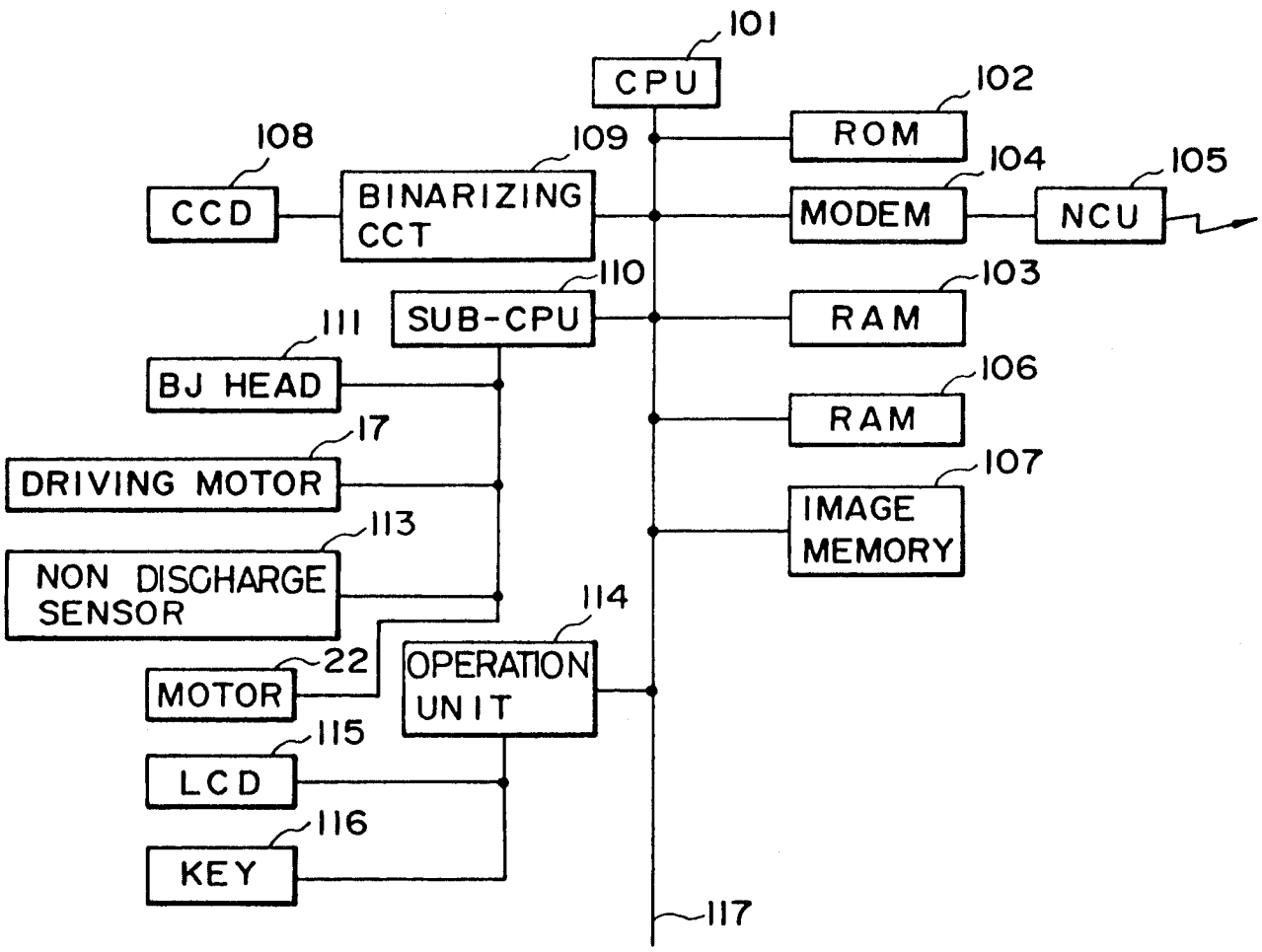
FIG. 4 is a block diagram of the circuit of a facsimile apparatus embodying the present invention.
Figure 5:
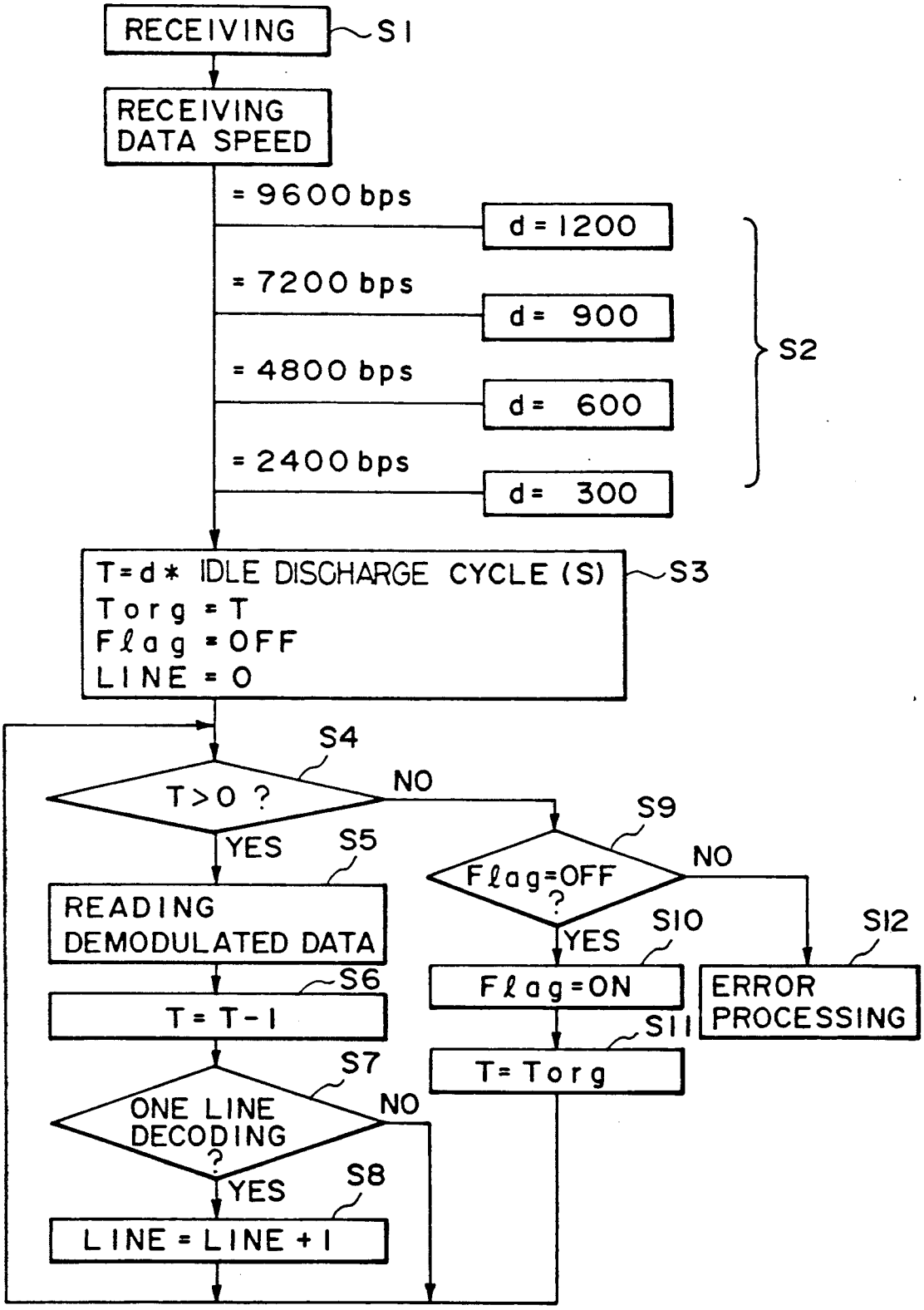
FIGS. 5 and 6 are flow charts of the control sequence on the timing of idle discharge in an embodiment of the present invention.

FIG. 4 shows an example of the circuit of the facsimile apparatus embodying the present invention, wherein shown are a main CPU (central processing unit) 101 such as a microcomputer for controlling, through a bus 117, the entire apparatus for data transmission and reception; a ROM (readonly memory) 102 for storing various control programs for the CPU 101 as shown in FIG. 5; a work RAM (random access memory) 103 used as counters and registers of the CPU 101; a modulator-demodulator (MODEM) 104 for data transmission; a network control unit (NCU) 105 for connecting the modem 104 with a public telephone line; a RAM 106 for registering data such as telephone numbers and abbreviated names; and an image RAM (DRAM) 107 for temporarily storing image data.

A CCD (charge-coupled device) 108, serving as image pickup means of the original reading unit, converts an original image, focused through an imaging lens such as a rod lens array, into an electrical signal. A binary digitizing circuit 109 binarizes the output signal of the CCD 108.

Figure 6:
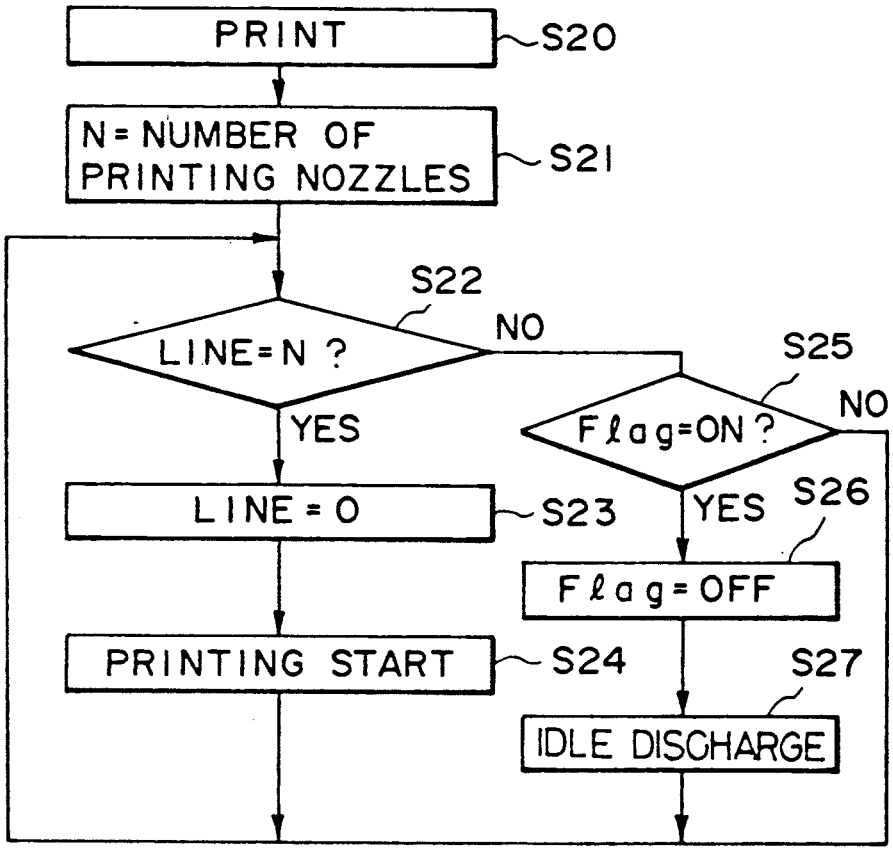

The recording head 111 is incorporated in a recording system, which is composed, in the present embodiment of an ink jet recording apparatus of a type discharging ink utilizing thermal energy as shown in FIGS. 2 and 3. A sub CPU 110 controls the ink jet head 111, a motor 17 for driving the carriage, a motor 22 for driving the recovery unit 26, a non-discharge sensor 113 etc. and is provided therein with a ROM for storing control programs for image recording as shown in FIG. 6.

An operation unit 114 is provided with a keyboard containing various keys 116 and a liquid crystal display unit (LCD) 115.

Example of Control Sequence

In the following there will be explained an example of a control sequence for idle ink discharge in the facsimile apparatus embodying the present invention, with reference to FIGS. 5 and 6.

FIG. 5 shows the control sequence to be executed by the main CPU 101 shown in FIG. 4. At an image reception through the network control unit 105, when a preliminary procedure for data reception is completed according to a communication protocol such as G3 (step S1), there is set a number d of received data in the unit of bytes per second, based on the central data receiving rate specified in said preliminary procedure.

For example said number d is set as "1200" for a data receiving rate of 9600 bps (bits/sec) (step S2).

Then the product of said received data number d and a desired idle discharge cycle (sec) is stored in a counter T. For example, for d=1200 (bytes/sec) and for an idle discharge cycle of 60 seconds, namely an idle discharge operation in every 60 seconds, the product T is equal to 72000 (bytes) which correspond to the number of data received in 60 seconds. At the same time said value T is stored in a counter resetting register Torg, a flag register Flag is turned off, and a line counter LINE is set at "0" (step S3).

Then the count of said counter T is discriminated (step S4), and, if it is zero, the sequence proceeds to a step S9 to be explained later. If said count is larger than zero, the compression encoded image data, which are demodulated in the modem 104, are read therefrom (step S5), and the count of the counter T is decreased by "1" for the reading of every one byte of said compression encoded image data. In this operation, the control codes, such as EOL (end of line) code, included in the image data are also counted (step S6).

Subsequently it is discriminated whether the compression encoded image data, thus read, has reached a final print line. Said line is calculated in the unit of dots corresponding to the ink discharge openings in the sub scanning direction, and, for example in the A4 size, data of 1728 dots in the main scanning direction constitute a line (step S7). If the data amount does not reach a line, the sequence returns to the step S4 to repeat the above-explained procedure. If the data amount has reached a line, the count of the line counter LINE is increased by "1" (step S8), and the sequence returns to said step S4 to repeat the above-explained sequence.

The count of the counter T reaches "0" subsequently when the received image data amount reaches a value (for example 72000 bytes) corresponding to the idle discharge cycle (for example 60 seconds), so that the step S4 identifies T=0 and the sequence proceeds to the step S9. Consequently a sequence starting from the step S9 is repeatedly executed every predetermined time substantially corresponding to the desired idle discharge cycle, though there are certain errors in the scanning time. The step S9 discriminates whether the flag Flag for instructing the idle discharge is off, and, if it is off, said flag is turned on for instructing the idle discharge (step S10). Then the count of the counter T is reset to the value of the register Torg, namely to the initial value (step S11), and the sequence returns to the step S4.

On the other hand, if the step S9 identifies that said flag Flag is not off, there is identified an abnormal state in which the recording head 111 has not executed a proper idle discharge in response to the previous instruction therefor (cf. step S26 in FIG. 6) and an error process is executed. Said error process interrupts the printing operation or the communication, and displays an error message on the LCD 115. Also the operator confirms the print state by a non-discharge checking operation (step S12).

FIG. 6 shows the control sequence to be executed by the sub CPU 110 for controlling the recording system. In the present embodiment there is employed a serial printer as shown in FIG. 3, and the sequence shown in FIG. 6 is executed simultaneously with and independently from the control sequence of the CPU 101 shown in FIG. 5. At first, at the preliminary procedure explained above, in response to a print start command received from the main CPU 101 (step S20), the number of ink discharge openings (also called print nozzle number) in the sub scanning direction of the recording head 111 is set in a register N (step S21). Said value N indicates the number of lines, in the unit of dots, recordable by the recording head at a time, and, for example, N is set as "50" if the recording head 111 has 50 discharge openings in the sub scanning direction. Said number N is usually fixed, but, in the present embodiment, even if the recording head is changed to another with different number of discharge openings, such change can be easily coped with by a change in the number N in the step S21.

Then it is discriminated whether the count of the line counter LINE shown in FIG. 5 coincides with that of the register (step S22), and, if not, the sequence proceeds to a step S25 to be explained later. If that discrimination establishes such coincidence, thus indicating that image data for a scanning motion of the recording head have been read, the line counter LINE is reset to "0" (step S23), then the printing operation is started by controlling the recording head 111 and the driving motor 17 (step S24), and the sequence returns to the step S22.

If the step S22 identifies that the count of the counter LINE does not coincide with that of the register N, the step S25 discriminates whether the flag FLAG shown in FIG. 5 is on, and, if not, where the idle discharge has not been instructed, the sequence returns to the step S22 to repeat the above-explained sequence. On the other hand, if said Flag is on, indicating that the idle discharge has been instructed, said Flag is reset to "off" (step S26), then an idle discharge process is conducted (step S27), and the sequence returns to said step S22.

The idle discharge operation in said step S27 is conducted for example in the following manner. Referring to FIG. 3, the recording head 20 is moved by the motor 17 to the position of the cap 26A in response to an instruction for idle discharge, and drive pulses are uniformly applied to the heat generating members of all the discharge openings of said recording head 20, thereby effecting forced ink discharges not intended for image recording (thus called idle discharges) of about 10 times from all the discharge openings, toward the cap 26A. In this operation the cap 26A need not cover the recording head 20 but may be separated therefrom, and the ink discharged into the cap 26A is collected in the recovery unit 26.

The control sequence of the present embodiment is shared by the main CPU 101 and the sub CPU 110, but the present invention is not limited to such embodiment and a similar control operation can naturally be conducted by a single CPU.

Other Embodiments

Figure 7:
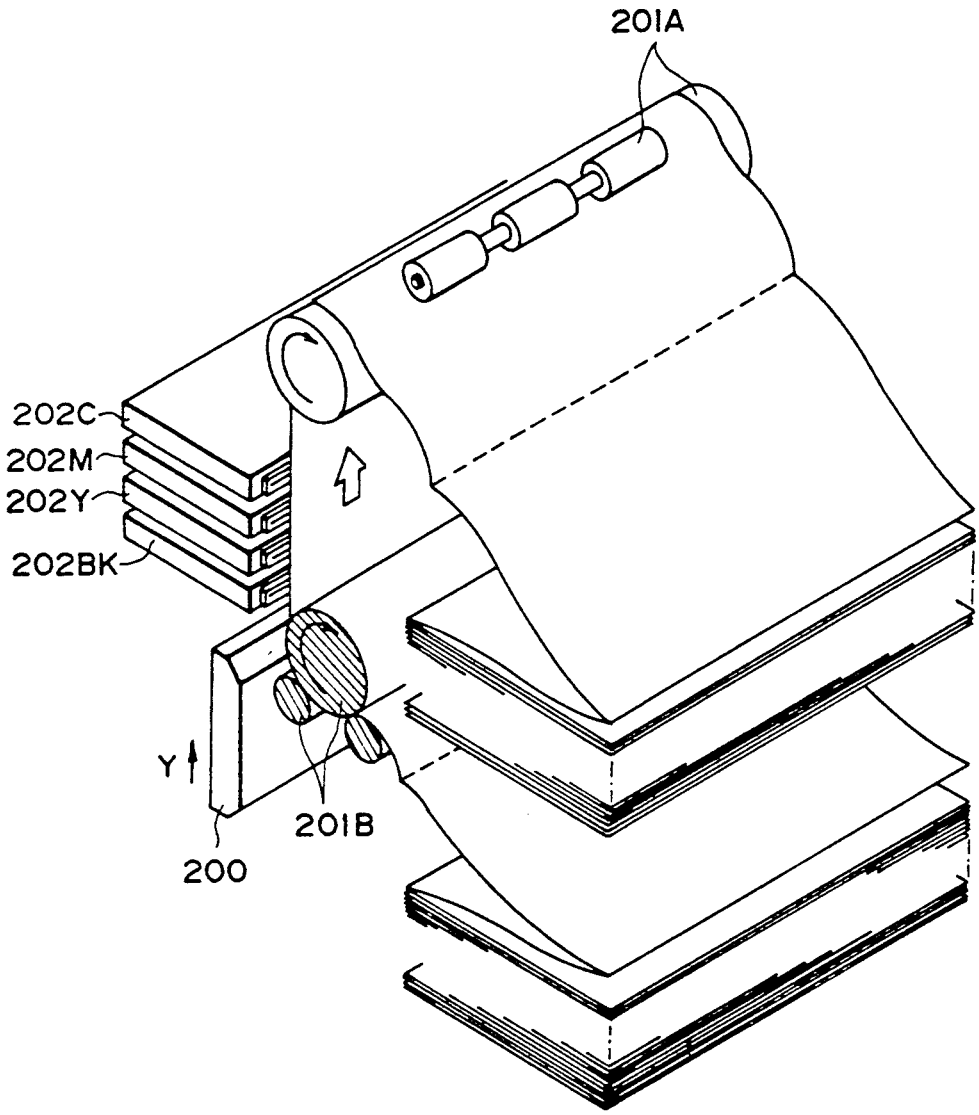
FIG. 7 is a perspective view of an ink jet recording apparatus of full-line type constituting another embodiment of the present invention.
Figure 8:
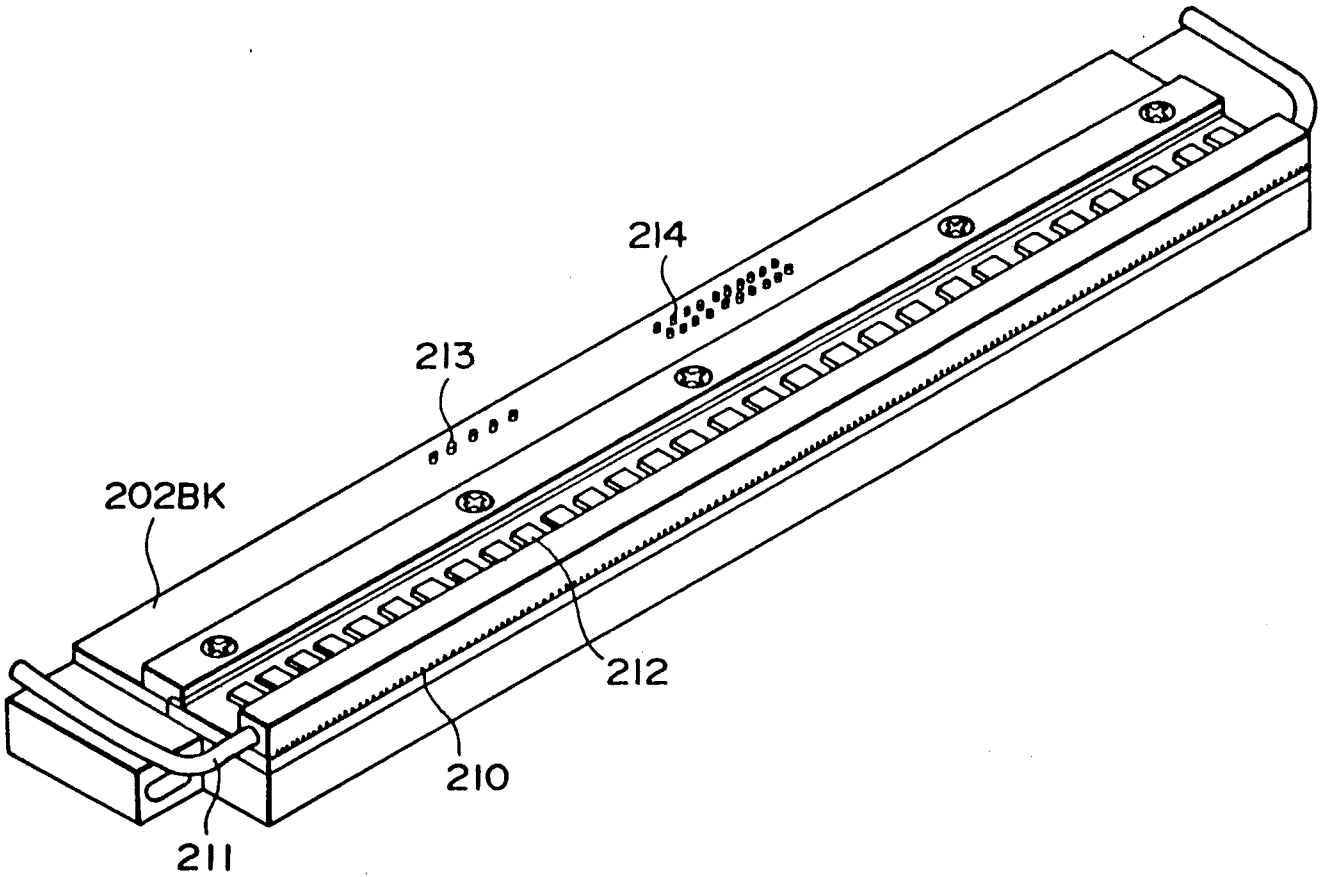
FIG. 8 a perspective view of the recording head shown in FIG. 7.

The present invention is applicable not only to the above-explained serial printer but also to a facsimile apparatus equipped with an ink jet recording apparatus with a recording head of full-line type, having a length corresponding to the maximum width of recording medium recordable by said apparatus as shown in FIGS. 7 and 8.

Referring to FIG. 7, there are shown paired rollers 201A, 201B for supporting and transporting a recording medium R in a sub scanning direction Y indicated by an arrow; and full-line multitype recording heads 202BK, 202Y, 202M and 202C arranged in this order from the upstream side of the transporting direction of the recording medium R and respectively having nozzles over the entire width of the recording medium R for respectively recording black, yellow, magenta and cyan colors.

Control sequences shown in FIGS. 5 and 6 are also usable in case of applying the present invention to a facsimile apparatus equipped with a printer of such full-line type. In this case the value N in the step S21 in FIG. 6 indicates the number of lines (in the unit of dots) scanned by the recording head at a time in the sub scanning direction, and may be equal to "1".

The present invention is also applicable to a facsimile apparatus employing an ink jet recording apparatus of so-called piezo type, utilizing piezoelectric elements as the source of energy for ink discharge.

Among various ink jet recording methods, the present invention is particularly advantageously applicable to the recording head and recording apparatus of a bubble jet system, because such system has the ability of attaining higher density and definition in the recording.

The representative structure and principle of such a bubble jet system are preferably based on the basic principle disclosed for example in U.S. Pat. Nos. 4,723,129 and 4,740,796. This system is applicable to a so-called on-demand type and continuous type ink jet recording, but is particularly effective in the on-demand recording by providing an electrothermal converting element positioned corresponding to each liquid path or sheet containing liquid (ink) with at least a drive signal corresponding to the recording information and inducing a rapid temperature increase exceeding nucleate boiling, thereby causing said converting element to generate thermal energy for inducing membrance boiling on a heat action surface of the recording head, thus generating a bubble in said liquid (ink) corresponding one-to-one to said drive signal. The liquid (ink) is discharged from a discharge opening by the expansion and contraction of said bubble, thereby forming at least a droplet. A pulse-shaped drive signal is particularly preferable as it achieves immediate expansion and contraction of the bubble, thereby realizing highly responsive ink discharge. Such pulse-shaped drive signal is preferably disclosed in U.S. Pat. Nos. 4,463,359 and 4,345,262. A further improved recording can be achieved by the conditions disclosed in U.S. Pat. No. 4,313,124 concerning the temperature increase rate of said thermal action surface.

The present invention includes the structure of the recording head not only obtained by the combinations of discharge openings, liquid paths and electrothermal converting members disclosed in the above-mentioned patents (those with linear or rectangularly bent liquid paths), but also the structure disclosed in U.S. Pat. Nos. 4,558,333 and 4,459,600 in which the thermal action portion is provided in a bent area. In addition the present invention is also effective in a sturcture having a common slit as the discharge opening for plural electrothermal converting elements as disclosed in Japanese Laid-open Patent Application Sho 59-123670 or a structure having an aperture for absorbing the pressure wave of thermal energy corresponding to discharge opening, as disclosed in the Japanese Laid-open Patent Application 59-138461, because the recording can be securely and efficiently conducted regardless of the form of the recording head.

The present invention is furthermore applicable effectively to the recording head of full-line type, having a length corresponding to the maximum width of the recording medium recordable on the recording apparatus. Such recording head may be composed of a combination of plural heads to attain said length, or integrally formed as a single head. Also in case of a serial printer, the present invention is effective in a replaceable recording head of chip type which can be electrically connected with the main body of the apparatus or can receive ink supply therefrom when mounted on said main body, or a recording head of cartridge type constructed integral with the recording head itself.

Also in the present invention, there is preferably added recovery means or auxiliary means for the recording head, such as capping means, cleaning means, pressurizing means or suction means, preliminary heating means composed of electrothermal converting elements and/or other heating elements, and means for effecting a preliminary discharge mode different from that for image recording, in order to achieve stable recording operation.

Also there may be employed not only a recording head for a single ink but also plural recording heads corresponding to plural inks different in colors and/or density.

Furthermore, the ink jet recording apparatus of the present invention may be employed not only in a facsimile apparatus but also as an image output terminal for an information processing equipment such as a computer, or a copying apparatus by the combination with a reader.

As explained in the foregoing, the present invention can securely provide the timing for idle discharge without requiring a particular timer interruption procedure, since said timing is defined from the data receiving rate of the image data and the number of actually received data. Thus the present invention can alleviate the burden on the CPU by eliminating the undesirable interruption procedure, thereby improving the performance of the CPU. Also the control program can be simplified and the cost can be reduced.

We claim:

1. An image communicating apparatus for recording an image with a recording head capable of discharging ink from discharge openings utilizing energy generated by discharge energy generating elements, the apparatus comprising:

communication means for receiving image data transmitted at a predetermined transmission rate from transmitting apparatus capable of transmitting the image data to the image communicating apparatus at plural predetermined transmission rates;

drive means for driving said recording head to record an image in accordance with the image data received by said communication means;

instruction means for counting the image data received by said communication means and for generating an instruction signal for initiating an idle discharge of ink, not intended for recording, by said recording head, the instruction signal being generated whenever a predetermined amount of image data have been received, wherein the predetermined amount of image data is varied in accordance with the transmission rate of the image data; and idle discharge means responsive to the instruction signal for effecting an idle discharge by said recording head.

2. An apparatus according to claim 1, wherein the predetermined amount of image data is the amount of data received within a predetermined time at a particular transmission rate.

3. An apparatus according to claim 1, wherein said discharge energy generating elements are adapted to generate thermal energy utilized to induce a state change in the ink, and the ink is discharged from said discharge opening based on the state change, thereby forming a flying droplet.

4. An apparatus according to claim 3, wherein said state change includes bubble formation by film boiling.

5. An apparatus according to claim 2, wherein said discharge energy generating elements are adapted to generate thermal energy utilized to induce a state change in the ink, and the ink is discharged from said discharge opening based on the state change, thereby forming a flying droplet.

6. An apparatus according to claim 5, wherein said state change includes bubble formation by film boiling.

7. An apparatus according to claim 1, further comprising determination means for determining during a receiving processing performed on the image data the predetermined transmission rate at which the image data is being transmitted.

8. An apparatus according to claim 7, wherein said discharge energy generating elements are adapted to generate thermal energy utilized to induce a state change in the ink, and the ink is discharged from said discharge opening based on the state change, thereby forming a flying droplet.

9. An apparatus according to claim 8, wherein said state change includes bubble formation by film boiling.

* * * * *